US005307603A

United States Patent [19]

Chiodo

[11] Patent Number: 5,307,603

[45] Date of Patent: May 3, 1994

[54] ANCHOR DEVICE

[76] Inventor: Daniel J. Chiodo, 2260 W. 77th St., Hialeah, Fla. 33016

[21] Appl. No.: 972,363

[22] Filed: Nov. 5, 1992

[51] Int. Cl.[5] ..... E04B 1/38

[52] U.S. Cl. ..... 52/698; 52/713; 52/297; 52/370

[58] Field of Search ..... 52/698, 262, 270, 284, 52/285, 294–297, 370, 712–714

[56] References Cited

U.S. PATENT DOCUMENTS

| | | | |
|---|---|---|---|
| 1,423,991 | 7/1922 | Brooks | 52/713 X |
| 2,013,101 | 9/1935 | Inglee | 52/713 X |
| 2,182,579 | 12/1939 | Bolton et al. | 52/370 |
| 2,191,979 | 2/1940 | Bierbach | 52/370 |
| 3,998,026 | 12/1976 | Allen | 52/370 X |
| 4,096,677 | 6/1978 | Gilb | 52/297 |
| 4,199,908 | 4/1980 | Teeters | 52/295 |
| 4,527,375 | 7/1985 | Braginetz | 52/712 |
| 4,910,934 | 3/1990 | Hennings | 52/714 X |
| 4,924,648 | 5/1990 | Gilb et al. | 52/297 X |
| 4,995,206 | 2/1991 | Colonias et al. | 52/297 |

*Primary Examiner*—Peter M. Cuomo
*Assistant Examiner*—Suzanne L. Dino
*Attorney, Agent, or Firm*—Oltman and Flynn

[57] ABSTRACT

An anchoring apparatus is provided for securing a first beam to a structural member, including a first plate having a middle section, two end sections, and two ends, each end section being divided into adjacent strip portions by at least one cut extending to one end, a first strip portion at each end section being bent essentially perpendicular to the middle section, for receiving between the first strip portions the first beam, a second strip portion, and a structural member engaging portion extending essentially perpendicular to the middle section oppositely from the first strip portion, for engaging the structural member; a second plate having openings for receiving the second strip portions, and extending adjacent to the first beam, and a mechanism for fastening the second plate to the first plate. Where the structural member is a concrete member, the second strip portion is bent to form the engaging portion, for insertion into the cement of the concrete member before the cement cures, to anchor the first plate to the concrete member. Where the structural member is a second beam positioned essentially perpendicular to the first beam, and the middle section has outer edges two engaging portions are provided and include two essentially parallel, spaced apart plate sections, each plate section extending from one outer edge, for receiving between the plate sections the second beam, and a fastener extending through at least one of the plate sections for securing the first plate to the second beam.

6 Claims, 3 Drawing Sheets

ANCHOR DEVICE

BACKGROUND OF THE INVENTION

1. Field of the Invention

The present invention relates generally to the field of anchoring devices for securing structural building members together, and more specifically to an anchoring device for securing the bottom member of a truss to the top of a wall, a first embodiment serving to secure the bottom truss member to a concrete wall top edge, including an elongate first plate, positioned in a horizontal plane for purposes of discussion, and having a solid middle section and two end sections, each end section being divided by two parallel, longitudinal cuts into three parallel and adjacent strip portions, the two outer strip portions of each end section extending outward from the middle section to a certain distance to form level segments each including a nut resting on its side and welded to its upper surface, and then bending perpendicularly downward, the downward segments of the outer strip portions having anchoring barbs, for insertion into uncured cement at the top edge of a wall to anchor the first plate to the wall, the middle strip portion at each end section being bent upward adjacent to the middle section and perpendicular to the middle section for receiving between the middle strip portions the bottom truss member, and including a separate, second plate having parallel slots for perpendicularly receiving the remote ends of the two middle strip portions, and corner ports for perpendicularly receiving bolts to fasten to the welded nuts so that the second plate is secured to the first plate and against the bottom truss member; and to a second embodiment for securing the bottom truss member to a plank standing on a side edge along the top of a wall, the outer strip portions of which exclude the downward segments of the first embodiment and instead have parallel plate sections extending perpendicularly and downward from the outer edges of the outer strip portions for receiving between them the wall plank, and nails driven through holes in the plate sections and into the wall plank.

2. Description of the Prior Art

There have long been anchoring devices for securing beams to concrete structural members, and alternatively to perpendicular beams. The concrete anchors have often been large bolts, each bent at a right angle and placed in cement prior to curing. These bolts are typically heavy and expensive, concentrate the anchoring load on a single line, and fail to provide a secure and convenient coupling structure for attachment to a beam. The perpendicular beam anchors are typically straps and truss plates with ends bent a quarter turn relative to each other around their longitudinal axes, to present properly oriented faces for nailing onto perpendicular beams. A problem with these bent straps and truss plates is that they only attach to one face of each beam, so that two of them must be used to achieve balanced and secure anchoring. The additional number of skilled man hours necessary to fasten two separate anchors to each beam makes this option expensive. Another problem with the straps in particular is that they can pivot on their fasteners and permit a dangerous range of play between the beams.

It is thus an object of the present invention to provide an anchoring device for joining beams to concrete structural members, which each fasten to two faces of the beam for secure and economical connection.

It is also an object of the present invention to provide an anchoring device for joining two perpendicular beams together, which fastens to two faces of each beam for secure and economical connection.

It is another object of the present invention to provide such an anchoring device which includes a coupling structure for easy and fast attachment to beams.

It is still another object of the present invention to provide such an anchoring device of the first type which has multiple, spaced apart concrete anchoring elements for a more secure, distributed load.

It is finally an object of the present invention to provide such an anchoring device which is inexpensive to manufacture.

SUMMARY OF THE INVENTION

The present invention accomplishes the above-stated objectives, as well as others, as may be determined by a fair reading and interpretation of the entire specification.

An anchoring apparatus is provided for securing a first beam to a structural member, including a first plate having a middle section, two end sections, and two ends, each end section being divided into adjacent strip portions by at least one cut extending to one end, a first strip portion at each end section being bent essentially perpendicular to the middle section, for receiving between the first strip portions the first beam, a second strip portion, and a structural member engaging portion extending essentially perpendicular to the middle section oppositely from the first strip portion, for engaging the structural member; a second plate having openings for receiving the second strip portions, and extending adjacent to the first beam, and a mechanism for fastening the second plate to the first plate. Where the structural member is a concrete member, the second strip portion is bent to form the engaging portion, for insertion into the cement of the concrete member before the cement cures, to anchor the first plate to the concrete member. Where the structural member is a second beam positioned essentially perpendicular to the first beam, and the middle section has outer edges, two engaging portions are provided and include two essentially parallel, spaced apart plate sections, each plate section extending from one outer edge, for receiving between the plate sections the second beam, and a fastener extending through at least one of the plate sections for securing the first plate to the second beam. The fastening mechanism preferably includes a port in the second plate, a nut attached to the first plate, and a bolt extending through the port and into the nut. The fastening mechanism preferably also includes a barb on one first strip portion oriented to permit one opening in the second plate to slide onto but not off of the one first strip portion. Where the structural member is a concrete member, the second strip portion preferably extends outward from the middle section to a certain distance before bending downward, to more widely distribute the apparatus loading over the concrete member, and one engaging portion preferably has an anchoring barb. Two cuts are preferably provided at each end section to define three strip portions in each end section, where the middle strip portion at each end section constitutes one first strip portion, and where the two outer strip portions at each end section constitute one second strip portion.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figures 1, 2:
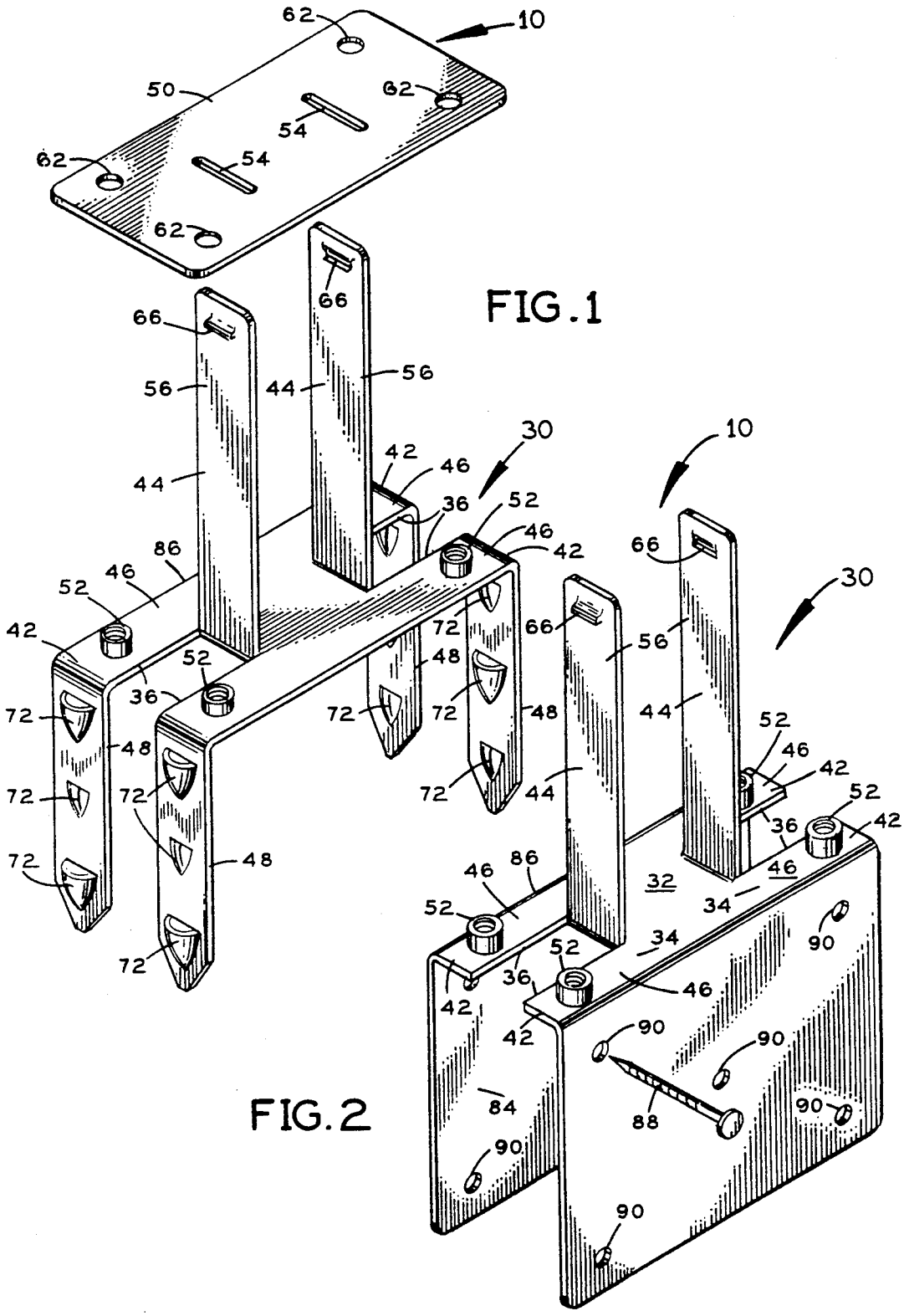
FIG. 1 is a perspective view of the first preferred embodiment of the inventive anchor device, for securing a beam to a concrete member.
FIG. 2 is a perspective view of the second preferred embodiment, for securing two essentially perpendicular beams together.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1 and 2, an anchoring device 10 is disclosed for securing structural building members together. The first embodiment is for securing the bottom beam 12 of a roof truss 14 to a concrete top edge 16 of a wall 20. The recited uses for each embodiment are merely exemplary, however, and many other uses are contemplated.

The first preferred embodiment of device 10 includes an elongate first plate 30 having a middle section 32 separating two co-planar ends 34. See FIG. 1 Each end section 34 is divided by two essentially parallel, longitudinal cuts 36 into three strip portions: two outer strip portions 42 and one middle strip portion 44. Outer strip portions 42 extend outward from middle section 32 to a certain distance, forming level segments 46. Then outer strip portions 42 bend perpendicularly downward, forming downward segments 48. A nut 52 is welded to the top surface of each level segment 46.

Figure 5:
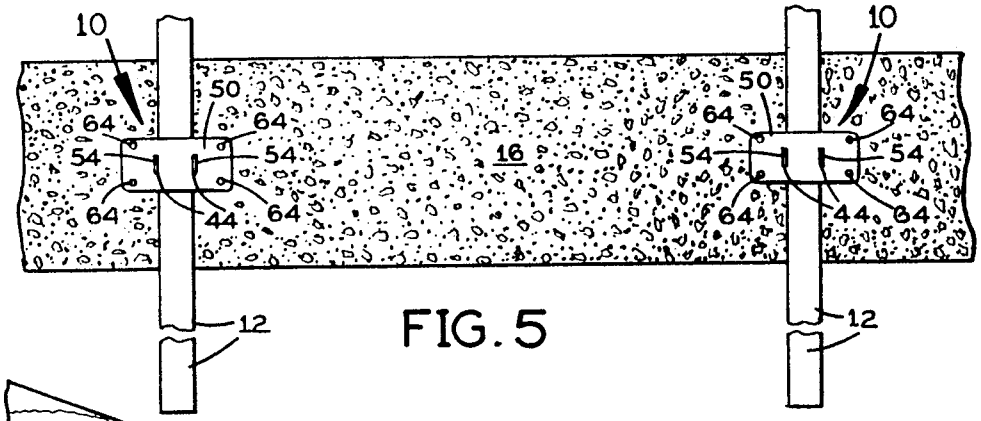
FIG. 5 is a top view of part of the truss and wall of FIG. 3, taken along line 5—5, including part of a second truss, illustrating the first preferred embodiment installed to connect each truss to the concrete top edge of the wall.
Figure 3:
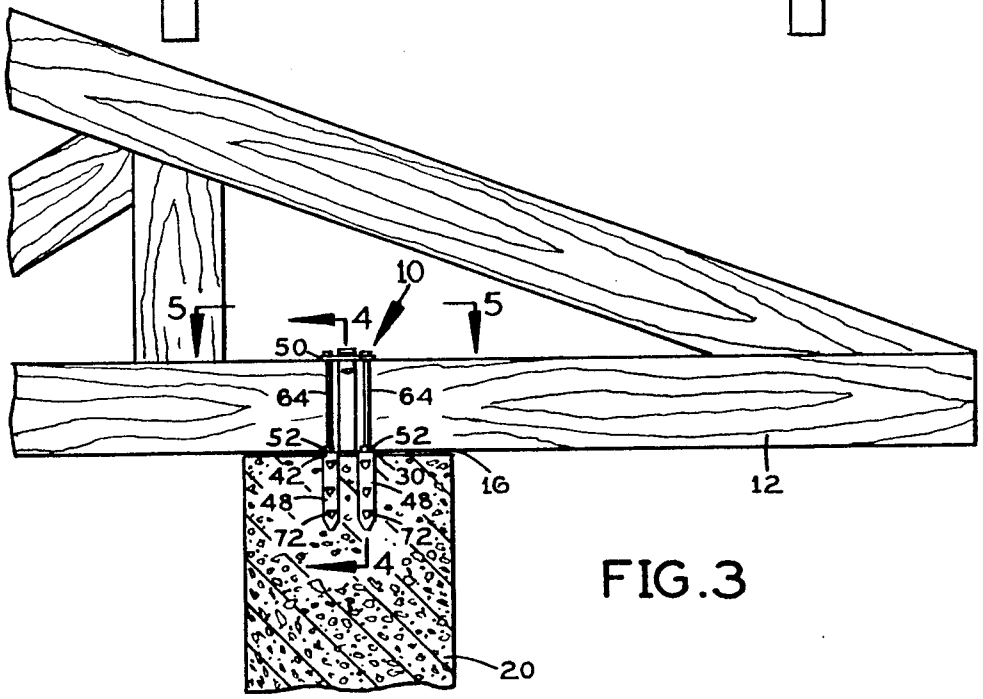
FIG. 3 is a side view of part of a truss and a truss supporting wall, illustrating the first preferred embodiment installed to connect the truss to the concrete top edge of the wall.
Figure 4:
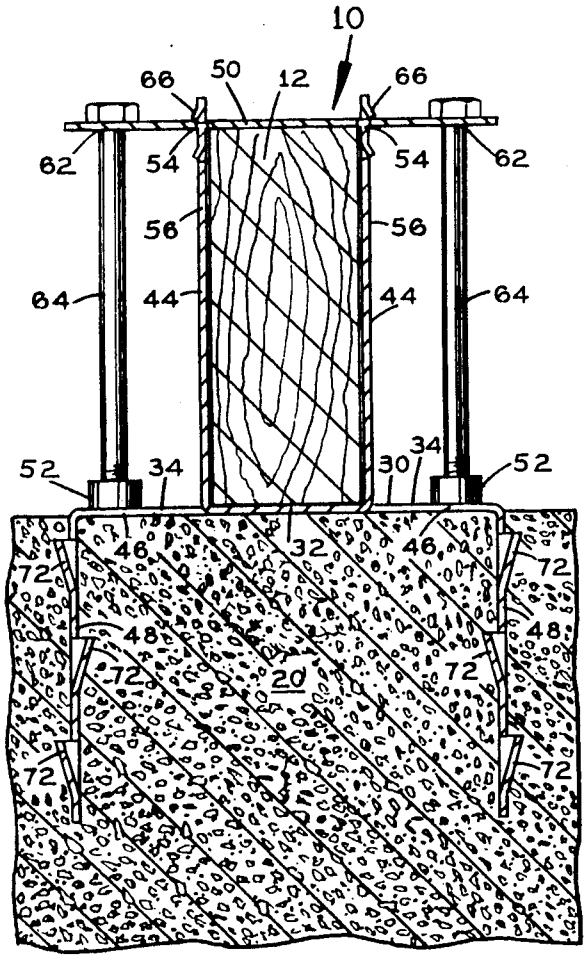
FIG. 4 is a close-up, cross-sectional view of the bottom beam of the truss of FIG. 3, taken along line 4—4, showing the installed first preferred embodiment in detail.
Figure 6:
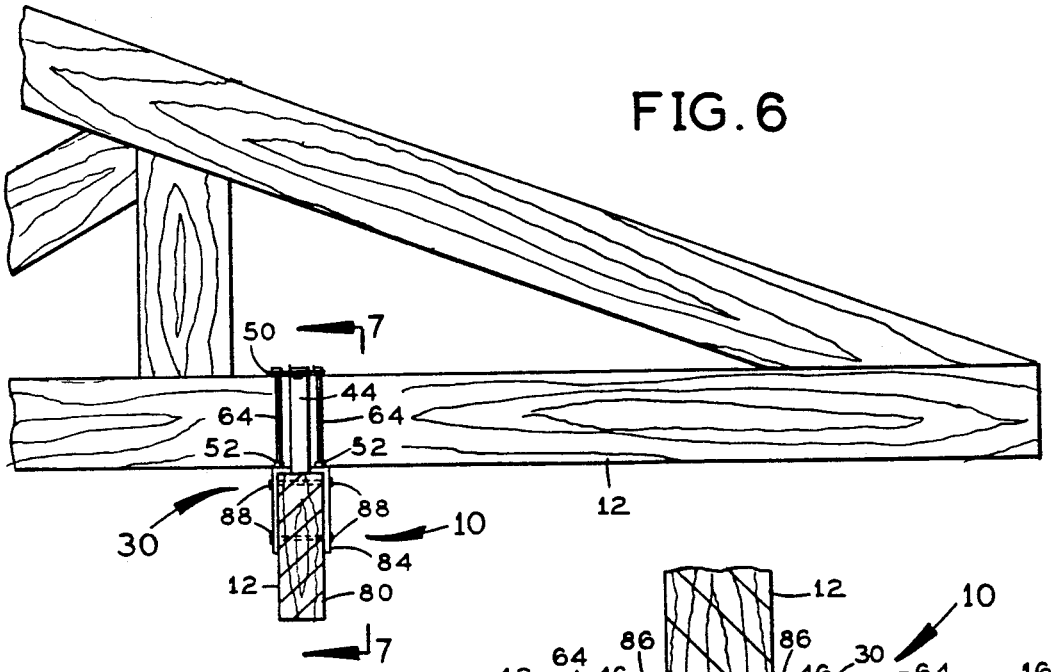
FIG. 6 is a side view of part of a truss and a truss supporting beam, illustrating the second preferred embodiment installed to connect the truss to the truss supporting beam.
Figure 8:
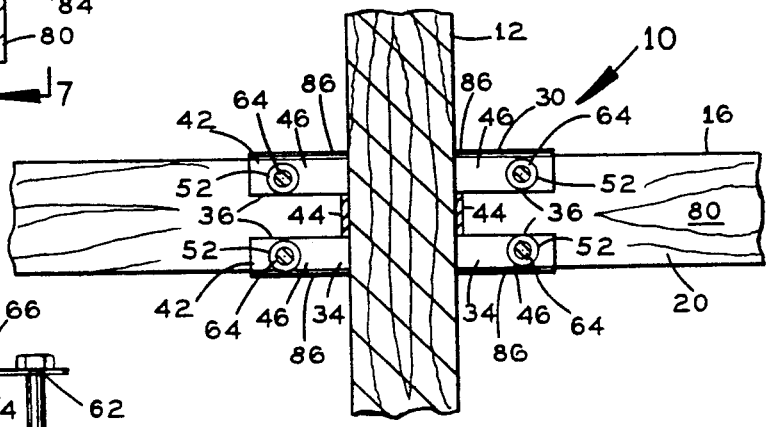
FIG. 8 is a top view of part of the truss and truss supporting beam of FIG. 7, taken along line 8—8, illustrating the second preferred embodiment installed to connect the truss to the truss supporting beam.
Figure 7:
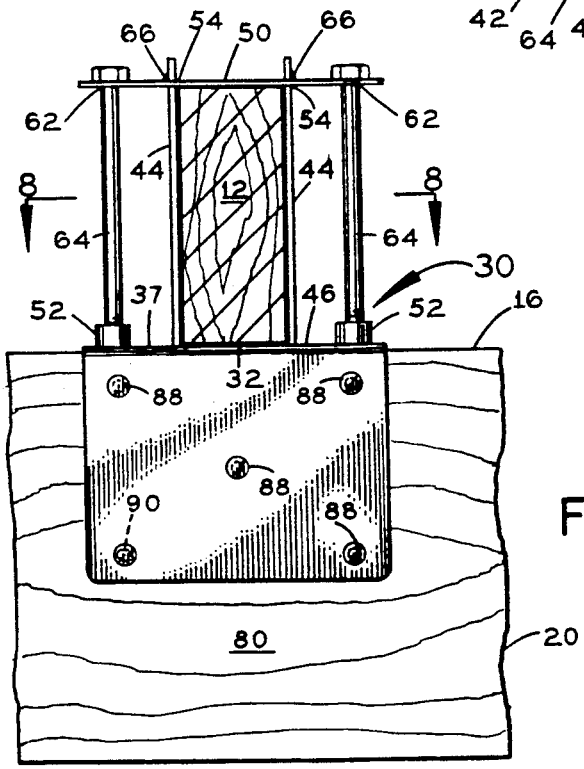
FIG. 7 is a close-up, cross-sectional view of the bottom beam of the truss of FIG. 6, taken along line 7—7, showing the installed second preferred embodiment in detail.

Downward segments 48 are for insertion into uncured cement at wall top edge 16 to anchor first plate 30 to wall 20. See FIGURES 3 through 5. Middle strip portions 44 are bent upward adjacent to middle section 32 and essentially perpendicular to middle section 32 for receiving between them a truss bottom beam 12.

A separate, second plate 50 is provided having parallel slots 54 for receiving the remote ends 56 of middle strip portions 44. Second plate 50 is placed over middle strip portions 44 and against bottom truss beam 12. Corner ports 62 are provided in second plate 50 for receiving corner bolts 64 which screw into nuts 52 and thereby secure second plate 50 against beam 12. See FIG. 1. Barbs 66 are preferably provided on middle strip portions 44. Plate 50 snaps over barbs 66 when fitted over strip portions 44, and barbs 66 prevent plate 50 removal. Barbs 66 are each preferably stamped out of strip portions 44 and have three edges.

Downward segments 48 of outer strip portions 42 preferably have anchoring barbs 72 for preventing downward segments 48 from sliding out of a concrete member. Barbs 72 are preferably stamped out, semi conical pockets having one edge, and protruding in a linear series from alternating sides of each strip portion 42.

Second Preferred Embodiment

A second embodiment of device 10 is provided for securing bottom truss beam 12 to a truss support beam or plank 80, typically attached along the top of a wall 20 so that its width extends vertically. The second embodiment of device 10 is like the first except that downward segments 48 are excluded and parallel plate sections 84 extend from outer edges 86 of outer strip portions 42. Plank 80 is received between parallel plate sections 84. See FIG. 2 and FIGS. 6 through 8. Nails 88 are driven through holes 90 in plate sections 84 and into plank 80.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An anchoring apparatus for securing a truss bottom beam across the top of a wall, comprising:

a first plate comprising an axis extending through two plate end sections, each said end section being divided by cuts substantially parallel to said axis into middle strip portions and two outer strip portions, said middle strip portions being bent upward substantially perpendicular to said first plate for receiving between them said truss bottom beam, a second plate having openings for receiving said middle strip portions and extending over and holding said truss bottom beam between said middle strip portions, means for fastening said second plate to said first plate comprising a port in said second plate, a nut attached to said first plate, and a bolt extending through said port and into said nut.

2. An anchoring apparatus for securing a truss bottom beam across the top of a substantially perpendicular concrete wall, comprising:

a first plate comprising a longitudinal axis extending through two plate end sections, each said end section being divided by cuts substantially parallel to said axis into middle strip portions and two outer strip portions, said middle strip portions being bent upward substantially perpendicular to said first plate for receiving between them said truss bottom beam, said outer strip portions being bent downward substantially perpendicular to said first plate for extending into said concrete wall to anchor said first plate to said concrete wall with a wide load distribution, a second plate having openings for receiving said middle strip portions and extending over and holding said truss bottom beam between said middle strip portions, means for fastening said second plate to said first plate, and additionally comprising a port in said second plate, a nut attached to said first plate, and a bolt extending through said port and into said nut.

3. An anchoring apparatus according to claim 2, additionally comprising barb elements on said downward directed outer strip portions for holding said outer strip portions in said concrete wall.

4. An anchoring apparatus for securing a truss bottom beam across a substantially perpendicular truss support plank comprising:

a first plate comprising a longitudinal axis extending through two plate end sections, each said end section being divided by cuts substantially parallel to said axis into middle strip portions and two outer strip portions, said middle strip portions being bent upward substantially perpendicular to said first plate for receiving between them said truss bottom beam, said first plate comprising two lateral outer edges substantially parallel with said axis and a plate section extending downward from each said outer edge substantially perpendicular to said first plate for retaining between them a truss support plank, a second plate having openings for receiving said middle strip portions and extending over and holding said truss bottom beam between said middle strip portions, means for fastening said second plate to said first plate.

5. An anchoring apparatus according to claim 4, additionally comprising nail receiving holes in said plate sections for receiving nails to secure said truss support plank between said plate sections.

6. An anchoring apparatus according to claim 4, additionally comprising a port in said second plate, a nut attached to said first plate, and a bolt extending through said port and into said nut.

* * * * *